United States Patent [19]

Spaulding

[11] 4,194,802

[45] Mar. 25, 1980

[54] INSULATION PIERCING CONTACTS AND CONNECTORS

[75] Inventor: Tedford H. Spaulding, Norridge, Ill.

[73] Assignee: Bunker Ramo Corporation, Oak Brook, Ill.

[21] Appl. No.: 846,365

[22] Filed: Oct. 28, 1977

Related U.S. Application Data

[63] Continuation of Ser. No. 723,158, Sep. 14, 1976, abandoned.

[51] Int. Cl.[2] ..... H01R 13/38

[52] U.S. Cl. ..... 339/97 P

[58] Field of Search ..... 339/97–99

[56] References Cited

U.S. PATENT DOCUMENTS

| | | | |
|---|---|---|---|
| 2,738,479 | 3/1956 | Gibson | 339/98 |
| 3,877,773 | 4/1975 | Doty et al. | 339/97 P |
| 3,897,128 | 7/1975 | Reavis, Jr. | 339/98 |

FOREIGN PATENT DOCUMENTS

| | | | |
|---|---|---|---|
| 542852 | 12/1955 | Belgium | 339/97 R |
| 2437399 | 2/1976 | Fed. Rep. of Germany | 339/97 R |
| 1006621 | 10/1965 | United Kingdom | 339/97 P |

*Primary Examiner*—Joseph H. McGlynn

*Attorney, Agent, or Firm*—F. M. Arbuckle; R. N. Muehleman; N. A. Camasto

[57] ABSTRACT

An electrical contact member formed from an axially extended tube is provided intermediate its ends with an axially extending insulation-opening slot. The slot is terminated at one end in an entry opening through the tube. The entry opening and an inwardly tapered entry ramp are formed by a free-ended piece of the tube wall bent into the inner opening of the tube. An insulated conductor may be inserted into the contact member in either of two ways: by insertion through the appropriate end of the tube and deflection by the entry ramp through the entry opening; or, by insertion through the entry opening and deflection by the entry ramp through the end of the tube. After insertion by either method, the ends of the insulated conductor may be pulled to force the conductor into a narrowed engagement portion of the slot where the insulation around the conductor is opened by spreading or cutting and electrical contact is made between the tube and the metallic conductor. The tube at a section apart from the slot may be crimped to secure the conductor after the conductor is positioned in the slot. A contact member or plurality of contact members may be assembled with insulating means to form a connector.

15 Claims, 5 Drawing Figures

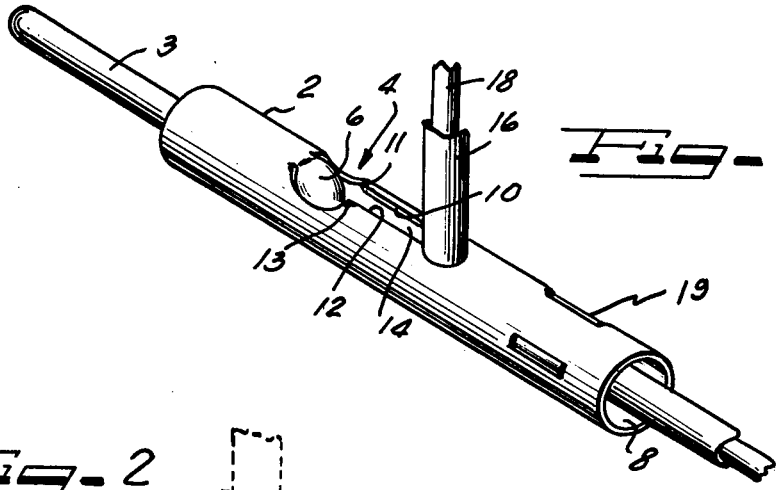
Fig. 1
Fig. 2
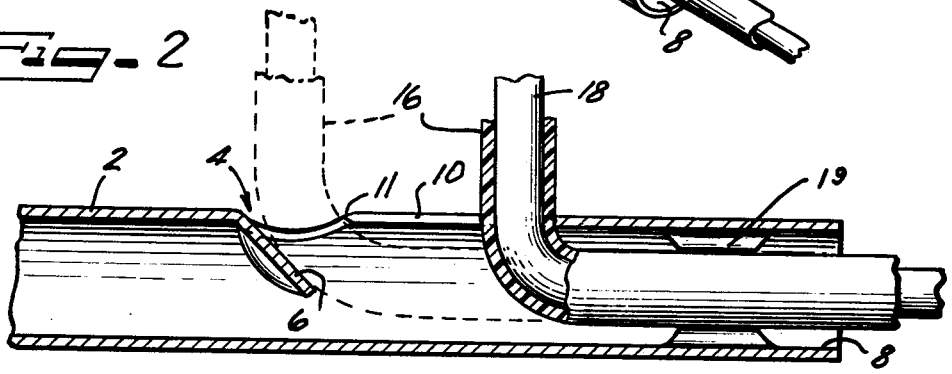
Fig. 3
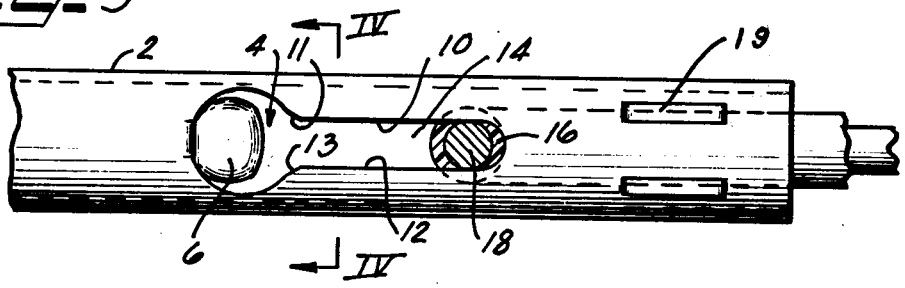
Fig. 4
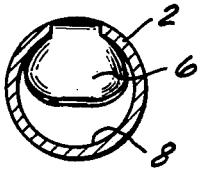
Fig. 5
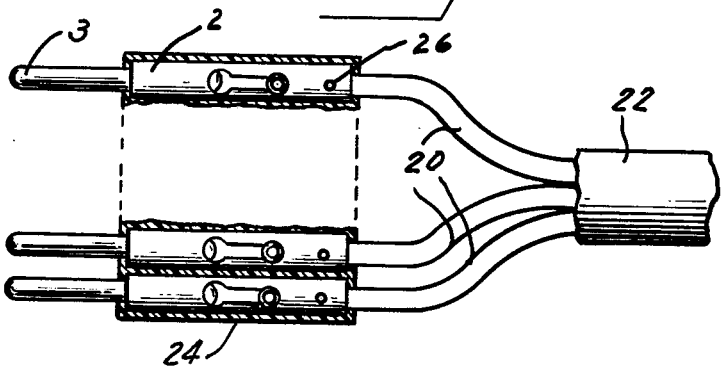

INSULATION PIERCING CONTACTS AND CONNECTORS

This is a continuation of application Ser. No. 723,158 filed Sept. 14, 1976, now abandoned.

BACKGROUND OF THE INVENTION

1. Field of the Invention

The invention relates to electrical contact members and electrical connectors and particularly to contact members employing insulation opening or penetrating means which are enabled to complete electrical connections when an insulated conductor is installed in the contact member. More particularly, the invention relates to an electrical contact member including a tube incorporating means enabling an insulated conductor to be threaded through the hollow interior of the tube and through the wall of the tube into contact with insulation opening means to enable completion of electrical engagement between the conductor and the contact member.

2. Description of the Prior Art

Among the prior art electrical contacts and connectors which incorporate means for opening or penetrating insulation of insulated conductors to expose the underlying conductor are devices, such as that shown in U.S. Pat. No. 3,147,058, which include insulation severing slots arranged in a cylindrical body to cut insulation around an insulated conductor and establish electrical engagement with the conductor. In this known art the insulation opening slots terminate in an open extremity at one end of the contact and the insulated conductor is introduced through that open extremity. There is no provision in this prior art for admitting the insulated conductor through the wall of the contact and no way in which the conductor may be twisted around the slot and through the contact.

Other prior art connectors include a family of connectors which are formed of two or more distinct parts. In connectors of this character, one part generally receives the insulated conductor and the parts are then closed together to sever the insulation, establish electrical engagement and secure the conductor to the connector. Clearly these devices do not anticipate the one-piece contact member exemplary of embodiments of the present invention.

SUMMARY OF THE INVENTION

Accordingly, it is an object of the present invention to provide an improved arrangement to enable connections to be completed between electrical contact members and insulated conductors. A further object is to provide one-piece contact means incorporating inlets to receive insulated conductors and insulation opening means to complete connections between the conductors and the contact means. Another object is to provide insulation opening means integral to the wall portion of a contact tube and intermediate the ends of the tube. Yet a further object of the present invention is to provide an improved contact member which may be fashioned as a unit to make it possible to sever insulation of an insulated conductor, complete electrical connections and provide a strong mechanical linkage between the conductor and the contact member. Still another object is to provide contact members formed of a plurality of one piece insulation opening and contact means. Yet another object is to provide a one piece contact tail incorporating tubular end and side openings serving as inlets and outlets for insulated conductors and incorporating means for piercing insulation to complete electrical engagement between the contact tail and an insulated conductor. Still another object is to take advantage of tubular construction by providing an axially extending slot intermediate the ends of the tube such that the slot is strengthened against being enlarged by stresses during installation of a conductor. A related object is to provide reinforcement to a slot over that provided by a flat blade construction employing metal of equal strength.

To attain the foregoing and ancillary objects, one or more contact members are employed in which each contact member is formed as a tube provided with conductor receiving means closed ended at axially opposite locations along the tube and including insulation opening means with a slot radially extending through a wall portion. At one end, the slot is provided with tapered edges spaced apart to penetrate and separate insulation on an insulated conductor to expose the underlying conductor and elongated edges to engage and establish electrical engagement with the metallic conductor. The slot is terminated at the elongated edges by a closed end and at the opposite end is continuous with an entry opening through the wall portion of the tube to permit the insulated conductor to be inserted through the wall and moved transverse to its axis into the slot for insulation opening and electrical engagement with the edges of the slot. The entry opening at its end opposite the slot is also closed ended and bounded by a continuous peripheral portion of the tube.

To utilize the invention, the insulated conductor is passed through, or threaded through, both the entry opening and the open end of the tube and is then pulled into engagement with the insulation opening edges of the slot to sever the insulation, after which the conductor is pulled into electrical engagement with the elongated edges of the connector slot and thereby into electrical engagement with the connector. The tube may then be crimped to increase the strength of the mechanical connection between the connector and the conductor. In practice, one or more contact members may be mounted in insulating bodies to form a connector.

BRIEF DESCRIPTION OF THE DRAWINGS

The above mentioned and other features and objects of this invention and the manner of obtaining them will become more apparent, and the invention itself will be best understood by reference to the following description of an embodiment of the invention taken in conjunction with the accompanying drawings, in which FIG. 1 is a perspective view of an embodiment of the invention showing an insulated conductor, or wire, installed in a slot in a tube, FIG. 2 is a view of the embodiment of FIG. 1 in partial section showing an insulated wire secured in the slot, FIG. 3 is a plan view of an embodiment of the invention showing an installed wire in section, FIG. 4 is a sectional view along line IV—IV of FIG. 3, and FIG. 5 is an elevation in partial section of an exemplary connector according to the invention.

DESCRIPTION OF THE PREFERRED EMBODIMENT

Turning now to FIG. 1, a contact member or connector for use in the invention is shown at 2. This connector may be formed of sheet metal which is bent to form a tube having a seam (not illustrated). Alternatively, the connector may be formed from seamless tubing which is cut into tubes of suitable length for increased rigidity. Pin contact members such as that illustrated at 3 may be employed to complete connections to sockets (not shown). Alternatively, a socket may be substituted for the pin 3 enabling connections to be completed to pins which are not illustrated.

To prepare a tube to serve as a connector between a pin 3 or other contacting device and an electrical conductor, the individual tube is punched, or otherwise cut, to provide a hole, or opening, at 4. The hole is cut to a size suitable to permit an insulated conductor of prescribed diameter to pass through in a direction either into or out-of the tube. Piercing edges at 11 and 13 are formed to pierce the insulation 16 and prepare the conductor 18 to engage parallel edges 10 and 12 of the slot 14.

The entry opening and the slot though the wall of the tube are arranged so that they are surrounded by the wall portion with the advantage that the edges of the opening and of the slot are held to reduce their spreading apart or bending. The tube in this way prevents the wall portion of the slot from either spreading apart or bending, and thus decreasing the effectiveness of electrical connections more. It will be seen also that a slot bounded by a tube is far more resistant either to spreading apart or bending than a slot formed in a flat surface or a slot formed by separate flat surfaces formed from the same weight and of metal.

To facilitate assembly of the insulated wire into the tube, a flap 6, as an entry ramp, which in a preferred example is formed from the wall portion of the tube, is pushed into the tube as is shown most clearly in FIG. 2. Thereafter, when an insulated conductor is pushed into the tube, either through the entry opening 4 on the side of the tube or the opening 8 at the end of the tube, the wire is deflected by the flap 6 to exit through the other opening. In this way, the insulated conductor and the connector are positioned so that they then may be interlocked and electrically interconnected.

After the insulated conductor has been placed in the tube, as shown by the sectional outline of the insulated conductor at 16 in FIG. 2, the conductor is pulled against cutting surfaces at 11 and 13 which pierce the insulation 16 to enable electrical engagement to be established between the conductor 18 and the walls 10 and 12 of the slot 14, as indicated further in FIGS. 2 and 3. The tube may then be crimped, as at 19, by a crimping tool to secure the conductor and the connector together.

As is indicated in FIGS. 1–4, the flap 6 may be formed from the wall of the tube 2. It may be pressed down in a preferred embodiment at an angle of 45 degrees to the central axis of the tube. Set at this angle, the flap will deflect insulated conductors which are pressed into the tube through either opening. However, the flap will serve as a deflector when set at other angles and, in fact, may serve better as a deflector under some circumstances when set at some other angle. This flap may be circular, elongated, or have some other shape, if desired.

A contact member, or a plurality of contact members, may be housed in suitable individual compartments in an insulator body to form a connector. An example of such a connector is illustrated in FIG. 5, wherein a plurality of contact members 2 are shown in compartments of an insulated body which isolate them electrically from each other and hold them in place. In this example, each contact member 2 is connected electrically to the conductor portion on insulated conductor 20 which is part of a multiple conductor at 22. The insulated portion of each conductor is secured to its contact member 2 and then to the connector 24 by a crimp indicated by a circle at 26. The finished connector 24 may be connected to or separated from a suitable female connector (not shown) without requiring further attention to the individual conductors 2 or pins 3. The pins 3, may be replaced with female or other kinds of connectors without departing from the spirit of the invention.

While the principles of the invention have been described above in connection with specific apparatus and applications, it is to be understood that this description is made only by way of example and not as a limitation on the scope of the invention.

I claim:

1. An electrical contact member for termination of an insulation covered electrical conductor, comprising:

an axially extending peripherally closed metal tube including a wall portion, and insulation-opening means disposed axially within said wall portion and including a slot extending radially through said wall portion for exposing and providing electrical engagement between the conductor and said wall portion, said insulation-opening means including axially opposed closed ends and an entry opening adjacent said slot for passage of the conductor radially through said wall portion of said tube, said wall portion including axially extending edges partially forming said slot and continuously integral with said closed ends for reducing the tendency of said slot to open wider when the insulated conductor is introduced into engagement therewith, said wall portion including an inner section adjacent said slot and an entry ramp for angular deflection of the conductor for positioning the conductor in said section and through said wall portion.

2. The contact member of claim 1 including an insulated body supporting said member and forming in combination an electrical connector.

3. The contact member of claim 1 wherein said tube includes at least one extremity with an open end permitting access into the tube.

4. The contact member of claim 3 wherein said entry opening is continuous with said slot for passage of said conductor through said entry opening and movement axially in said slot for exposure of said conductor and electrical engagement thereof with said wall portion.

5. An electrical contact member for termination of an electrical conductor comprising:

an axially extending peripherally closed tube having a wall portion terminating in at least one opened end permitting excess into the tube, insulation-opening means extending through the wall of the tube, an entry opening providing an entry through the wall into the tube, the entry opening being located to terminate one end of the insulation-opening means, and an entry ramp extending radially and axially inwardly from the tube wall adjacent the entry opening into the tube, said entry ramp serving as a guide conductor deflecting guide for conductors threaded through the tube between the entry opening and the opened end.

6. The invention as claimed in claim 5, in which the entry ramp is integral to the tube and is formed of material displaced from the wall of the tube.

7. The invention as claimed in claim 5, in which the insulation-opening means includes a slot through the wall portion of the tube extending axially along the tube intermediate the ends thereof.

8. A connector comprising:

a peripherally closed tube having a wall and at least one pair or openings serving as ingress means and egress means permitting entry into and exit from said tube, each of said pair of openings being orthogonally disposed with respect to the other, deflection means positioned and extending radially and axially within said tube and extending from said tube wall to deflect an electrical conductor admitted into the tube through the ingress means and out of the tube through the egress means, and means for retaining the conductor in electrical engagement with the tube.

9. A connector comprising:

a peripherally closed tube having a wall and at least one pair of openings serving as ingress means and egress means permitting entry into and exit from said tube, each opening of said pair of opening being orthogonally disposed with respect to the other, deflection means positioned and extending radially and axially within said tube and extending from said tube wall to deflect a conductor admitted into the tube through the ingress means and out of the tube through the egress means, and means for opening insulation over a portion of said conductor to establish engagement between the connector and the conductor, and means, after the insulation is opened, for retaining said conductor in engagement with said tube.

10. The invention as claimed in claim 9, in which one opening of the tube is through the end of the tube, and the other opening is through the wall portion of the tube.

11. The invention as claimed in claim 9, in which the means for retaining said conductor includes a slot extending axially along the tube intermediate the ends thereof.

12. The invention as claimed in claim 9, in which the deflection means is positioned within the tube to deflect the insulated conductor at a right angle from a line of travel through the ingress opening into a line of travel through the egress opening.

13. The invention as claimed in claim 9, in which one opening of the tube is through the end of the tube, the other opening is through the wall of the tube, and the deflection means is located within the tube in a position relative to the two openings such that an insulated conductor entering the tube through one of them is deflected out of the tube through the other.

14. The invention as claimed in claim 13, in which the means for opening insulation over a portion of said conductor includes an insulation opening slot extending axially along the tube intermediate the ends thereof.

15. The invention as claimed in claim 13, in which the tube includes a portion to which a crimp may be applied to secure the insulated conductor in the tube.

* * * * *